United States Patent [19]

Baader

[11] Patent Number: 4,614,391

[45] Date of Patent: Sep. 30, 1986

[54] H-TERMINAL ASSEMBLY

[76] Inventor: Edward J. Baader, 4220 Springfield-Jamestown Rd., Springfield, Ohio 45502

[21] Appl. No.: 726,556

[22] Filed: Apr. 24, 1985

[51] Int. Cl.[4] ..... H01R 13/627

[52] U.S. Cl. ..... 339/91 R; 339/186 M; 339/210 M

[58] Field of Search ..... 339/91 R, 204, 205, 339/206 R, 210 R, 210 M, 184 R, 184 M, 186 R, 186 M

[56] References Cited

U.S. PATENT DOCUMENTS

| | | | |
|---|---|---|---|
| 2,820,211 | 1/1958 | Batcheller | 339/198 |
| 2,840,794 | 6/1958 | Batcheller | 339/220 |
| 2,924,808 | 2/1960 | Hewes et al. | 339/198 |
| 3,150,910 | 9/1964 | Dodd | 339/198 |
| 3,482,201 | 12/1969 | Schneck | 339/206 R |
| 3,530,424 | 9/1970 | Gregory | 339/91 R |
| 3,958,858 | 5/1976 | Silveira, Jr. | 339/186 M |
| 3,963,300 | 6/1976 | Patton et al. | 339/156 R |
| 4,526,431 | 7/1985 | Kasukawa | 339/91 R |

FOREIGN PATENT DOCUMENTS

| | | | |
|---|---|---|---|
| 642850 | 1/1964 | Belgium | 339/91 R |
| 33286 | 8/1981 | European Pat. Off. | 339/186 M |

*Primary Examiner*—John McQuade

[57] ABSTRACT

An H-terminal assembly for electrical wiring systems. Particularly, an H-terminal strip assembly block or housing wherein a plurality of connector heads may be keyed individually to an aligned series of H-terminal prongs extending from the top and bottom of the assembly. Pairs of key posts are maintained for each aligned row of H-terminal prongs for mating engagement with corresponding keyholes defined in the removable connector heads. The connector heads may be snap-fitted to the H-terminal assembly by engagement with resilient bayonet prongs, extending outwardly of the assembly.

5 Claims, 15 Drawing Figures

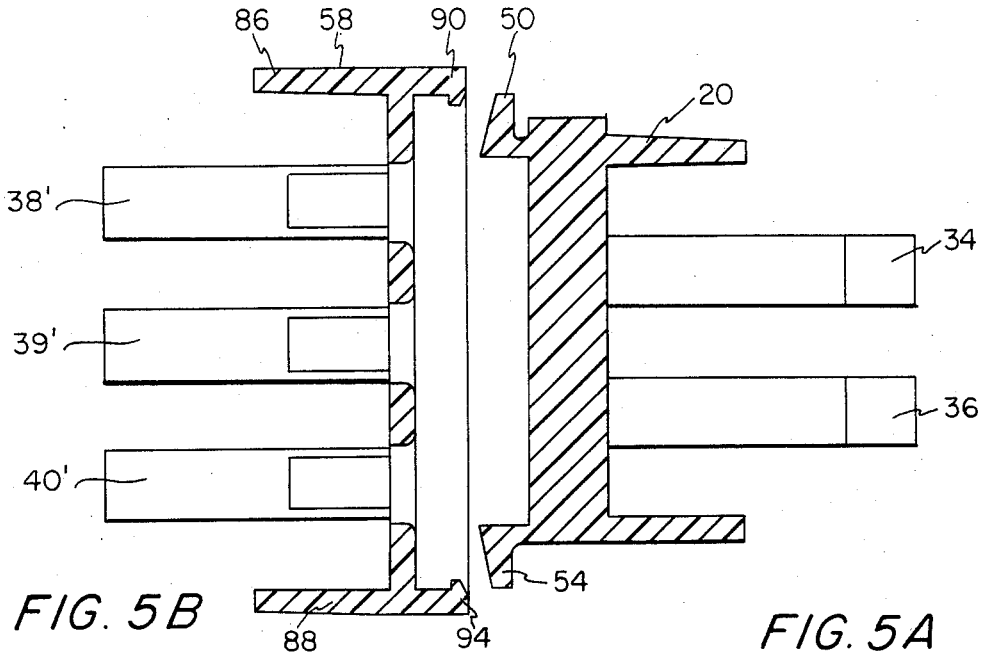
FIG. 5B
FIG. 5A
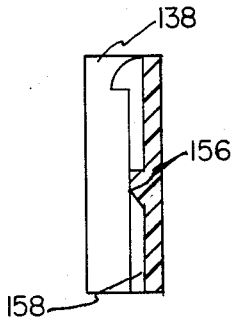
FIG. 10
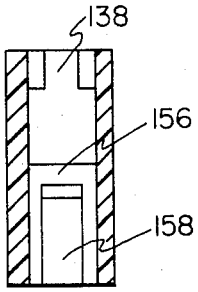
FIG. 11
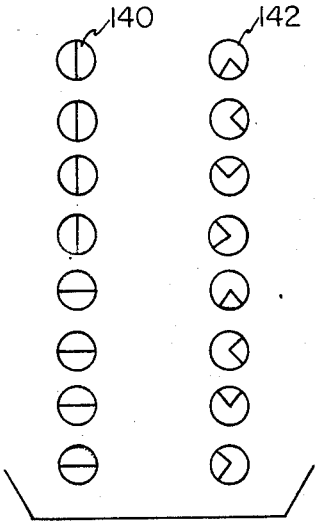
FIG. 12

H-TERMINAL ASSEMBLY

BACKGROUND OF THE INVENTION

1. Field of the Invention:

H-terminal assemblies for complex electrical wiring systems. For example, a terminal assembly for a school bus or truck wiring system wherein the harnesses for the individual turn signal, stop lamp, tail lamp, identification lamps, roof warning lamps, dome lights, and the like, are removably keyed into an H-terminal strip assembly block.

2. Description of the Prior Art:

BATCHELLER, U.S. Pat. No. 2,820,211
BATCHELLER, U.S. Pat. No. 2,840,794
HEWES et al., U.S. Pat. No. 2,294,808
DODD, U.S. Pat. No. 3,150,910
PATTON et al., U.S. Pat. No. 3,963,300
SILVERIA, JR., U.S. Pat. No. 3,958,858

SUMMARY OF THE INVENTION

An H-terminal assembly for electrical wiring systems of the type terminating in U-terminal connector heads, each connector head having as many as thirty wires with female leads. The H-terminal assembly includes a plurality of pronged H-terminals, a top section of insulating material defining a top planar base with a plurality of holes which register with the upwardly extending H-terminal top prongs and a bottom section of insulating material defining a bottom planar base with a plurality of holes aligned with those holes in the top section, so as to register with the downwardly extending H-terminal bottom prongs. The top and bottom sections are snap-fitted together over the H-terminal. The top and bottom sections may have key posts as well as bayonet prongs positioned at each end of the aligned holes, such that a connector head may be snap-fitted into the top and bottom sections, while the H-terminal prongs engage the female leads within connector head.

DESCRIPTION OF THE DRAWINGS

FIGS. 5A and 5B are enlarged schematics taken along the lines 5A—5A and 5B—5B of FIGS. 2 and 4 respectively.

FIG. 10 is a fragmentary vertical section, taken along section line 10—10 of FIG. 7.

FIG. 11 is a transverse section, taken along section line 11—11 of FIG. 7.

FIG. 12 is a schematic showing of pairs of key post combinations to ensure fail-safe fitting of the connector head in the appropriate H-terminal assembly row.

Figure 1:
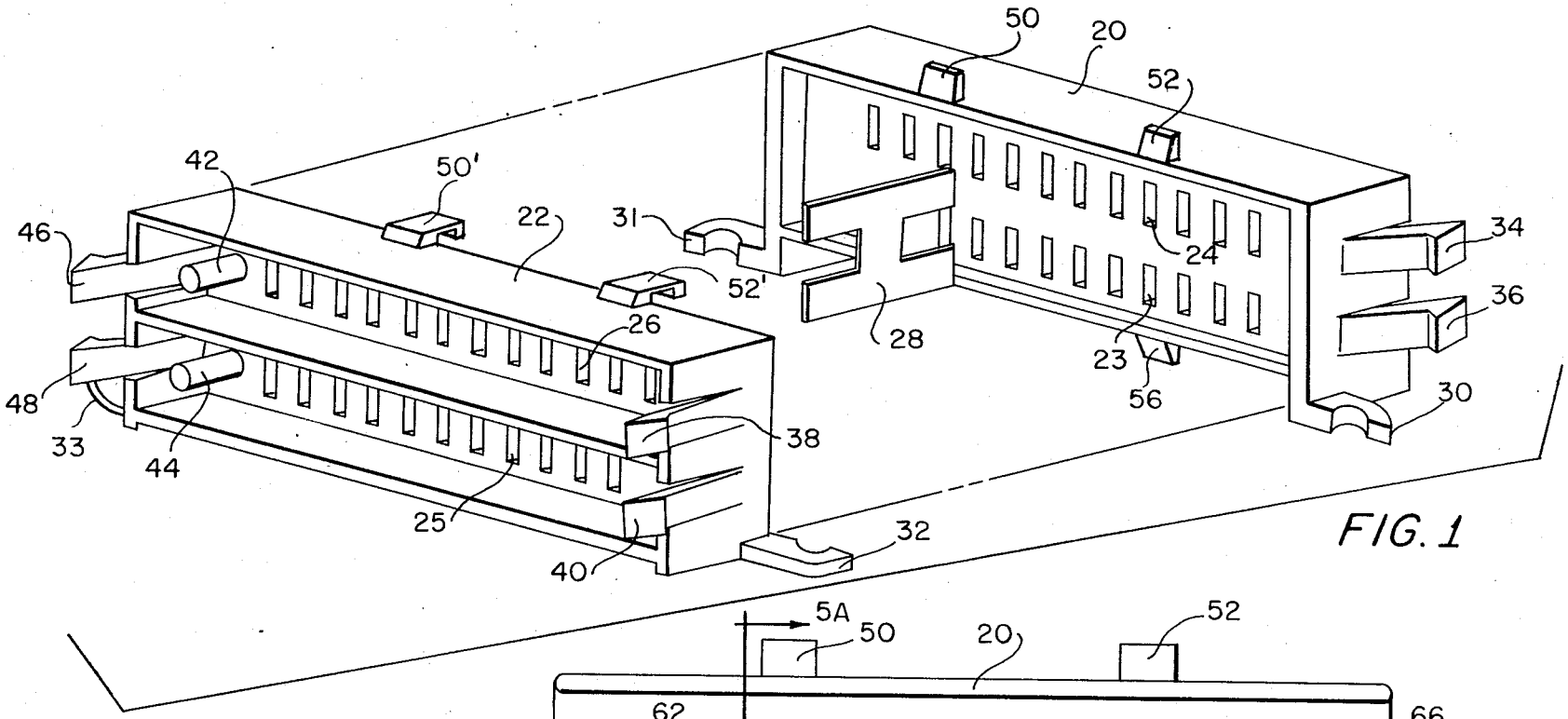
FIG. 1 is an exploded perspective view of the H-terminal assembly top and bottom sections prior to snap-fitting of the sections over the H-terminal prongs.

DESCRIPTION OF THE PREFERRED EMBODIMENTS:

In FIG. 1, the individual H-terminal 28 is shown positioned between the top section 20 and bottom section 22 of the H-terminal assembly. Top section 20 includes a pair of aligned series of holes 23, 24 for engagement with the top prongs of H-terminal 28 and bottom section 22 includes a pair of aligned holes 25, 26 for engagement with the bottom prongs at the other end of the H-terminal.

Figure 7:
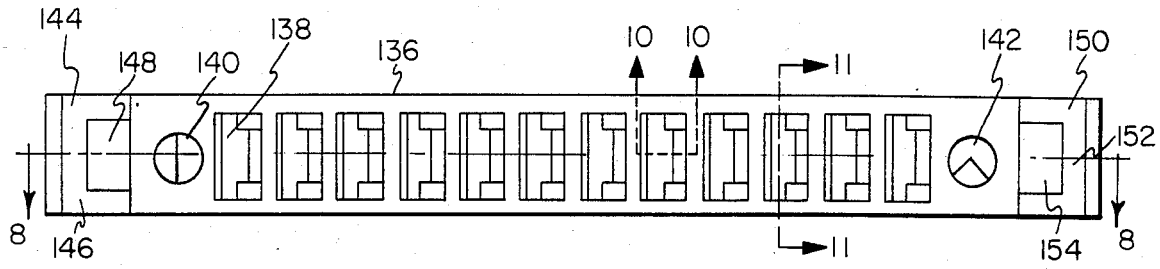
FIG. 7 is a top plan of a connector head of the type having a plurality of U terminals.

Correspondingly, pairs of bayonet prongs 34, 34'; 36, 36' may be positioned at either end of the aligned holes in top section 20 for engagement with a connector head 136 such as is illustrated in FIG. 7.

Top section 20 may include outwardly extending ears 30, 31 in the form of a half bracket which correspond to ears 32, 33, in the bottom section for forming a fastening bracket, as the top and bottom sections are joined together. Ear 33 being hidden from view in FIG. 1 corresponds in obverse form to its opposite, ear 31;

Bottom section 22 is shown as having pairs of key posts 42, 44, for engagement with mating keyholes 140, 142, as illustrated in connector head 136 in FIG. 7.

Figure 4:
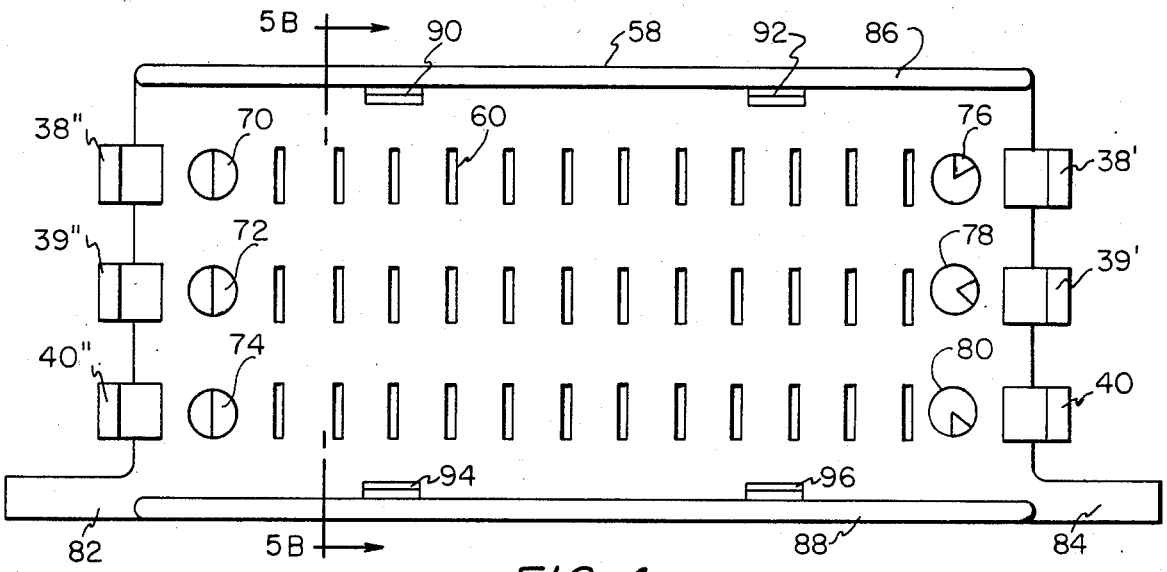
FIG. 4 is a bottom plan of a modified bottom section as in FIG. 13, showing three rows of aligned holes for the H-terminal prongs.

Brackets 50, 52 and 54 (not shown), 56 of section 20 are adapted to engage similar interlocking section 22 brackets 50', 52' of the type shown in FIG. 4, reference elements 90, 92; 94, 96. The FIG. 13 bracket arrangements are the same as in FIG. 4.

Figure 13:
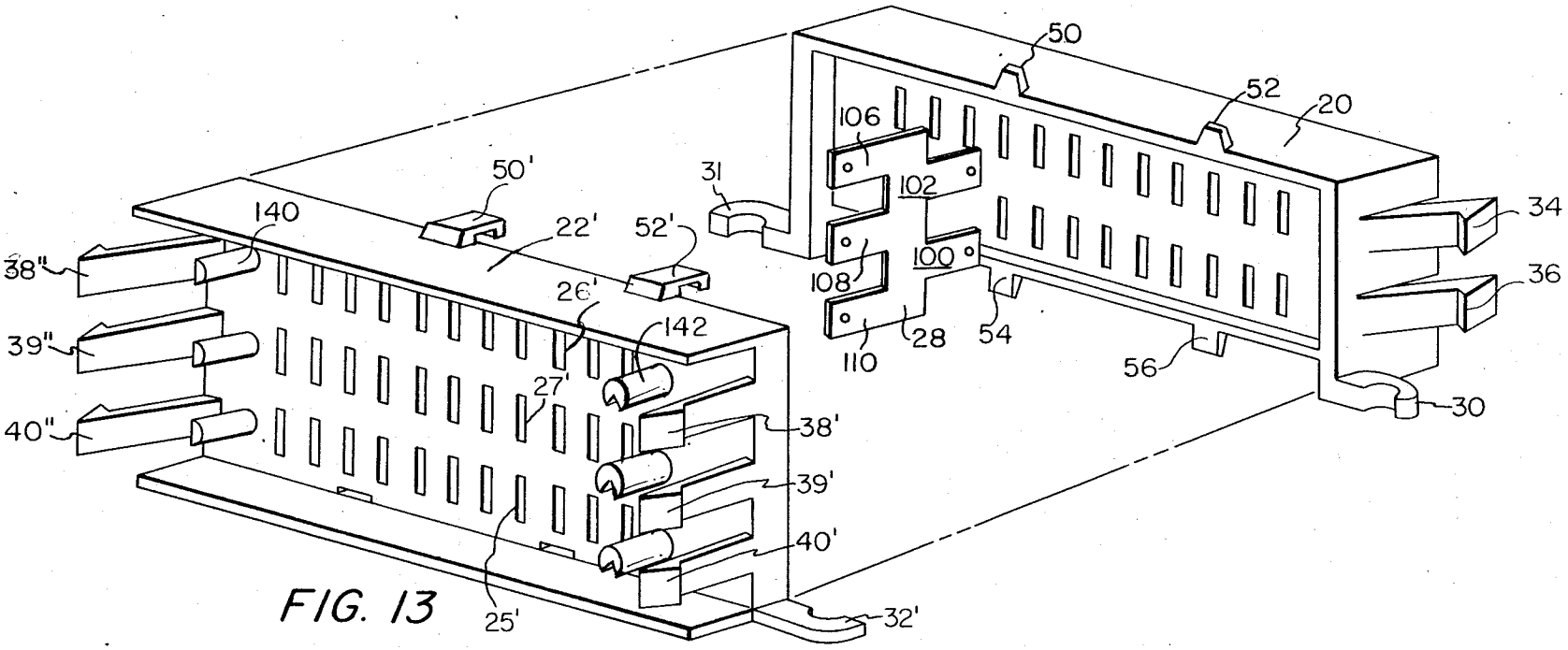
FIG. 13 is an exploded perspective of a modified housing supporting a five-prong H-terminal.
Figure 14:
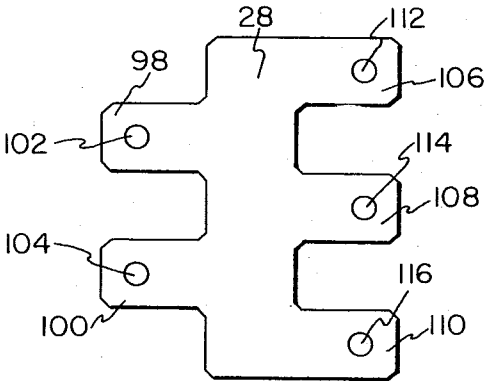
FIG. 14 is an enlarged plan view of a five-pronged H-terminal.

In the modification shown in FIG. 13, the terminal assembly is adapted for a five-prong H-terminal 28 of the type illustrated in FIG. 14. Terminal 28 includes at one end, two prongs, 98, 100, having apertures 102, 104 therein, and at the other end three prongs 106, 108, 110 with apertures 112, 114 and 116. The five-prong H-terminal may be manufactured half hard brass, $1\frac{1}{4}\times0.032$ inches.

Figure 2:
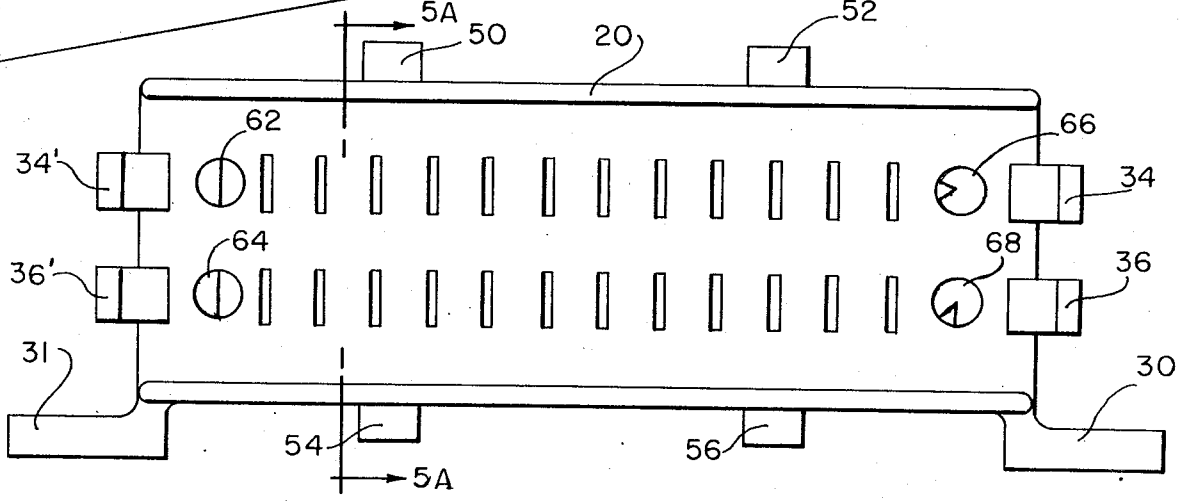
FIG. 2 is a top plan of the top section.
Figure 3:
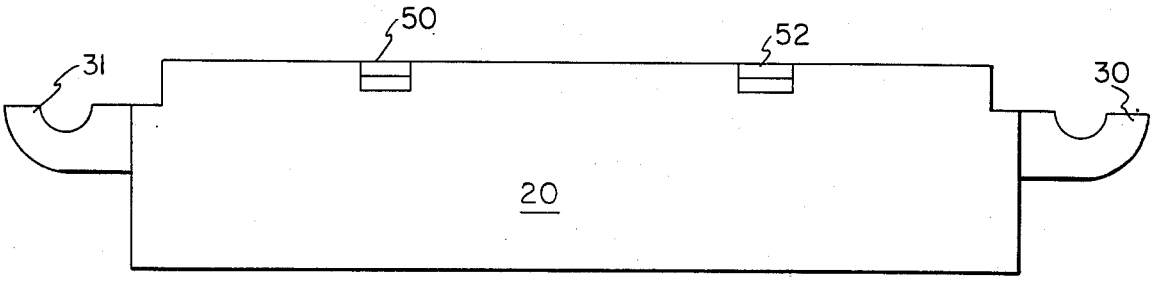
FIG. 3 is a side elevation of the top section.

In FIG. 2, top section 20, is illustrated as having a pair of key posts 62, 66 for one row of aligned holes and a second pair of key posts 64, 68 for the other row of aligned holes. Laterally extending lugs 50, 52, 54, 56 are provided for snap-fit engagement with corresponding brackets 90, 92, 94 and 96 in lower section 22.

In FIG. 4, the modified bottom section 58 is shown as having projecting walls 86, 88, as well as pairs of key posts 70–76; 72–78; 74–80 for mating with pairs of corresponding key holes in a connector head (not illustrated).

Attachment to such a connector head may be affected by means of triple pairs of bayonet prongs 38', 38''; 39', 39'' and 40', 40''. The extending ears 82, 84 have the same fastening function as their counterpart in top sections 20 or 20'.

Figure 6:
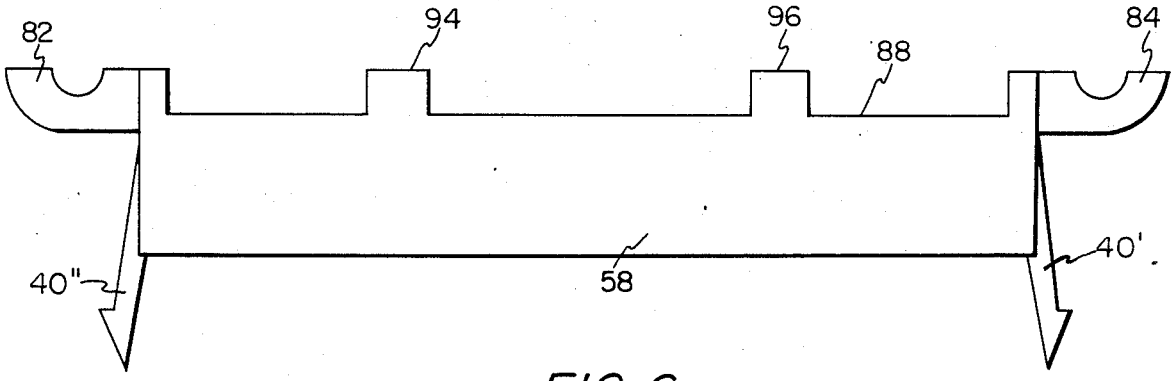
FIG. 6 is a side elevation of the three row modification illustrated in FIG. 4.

In FIGS. 4 and 6 configurations, the individual brackets 94, 96 are illustrated as providing engagement with the corresponding lugs 54, 56 of the top section 20. See also FIGS. 5A, 5B.

In FIGS. 5A and 5B, exploded views of top and bottom sections are shown. A modified top section 20 defines two rows of aligned poles, as in the original section 20 and two resilient prongs 34, 36. Also shown in section are the lugs 50, 54. The corresponding bottom triple row section 58 has brackets 90, 94 extending from walls 86, 88 respectively. Upon closure of these modified sections together, the laterally extending lugs 50, 54 are snap-fitted with respect to opposed brackets 90, 94.

In FIG. 7, connector head 136 of the type supporting a plurality of metallic terminals with as many as thirty wire leads is illustrated. Connector head 136 includes connector bracket 144 having inclined shoulder 146 and aperture 148 for engagement with the corresponding bayonet prong of the H-terminal assembly. At the other end, a similar bracket 150 has inclined shoulder 152 and aperture 154. A pair of keyhole apertures 140', 142' may be keyed to the appropriate pair of key posts illustrated in FIGS. 4 and 12. These connector keyhole apertures are partially filled and partially void, to provide fitting receptacles for the counterpart keys of the H-terminal. The combinations of FIGS. 2 and 7 are but two examples.

Figure 8:
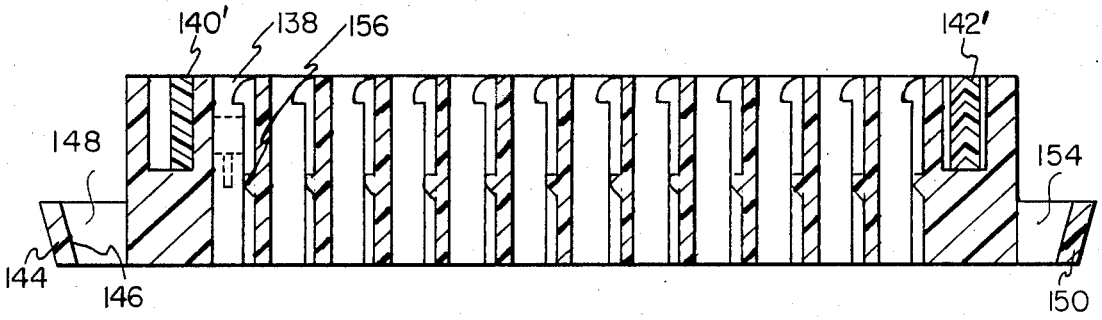
FIG. 8 is a longitudinal section of the connector head illustrated in FIG. 7 taken along the line 8—8 thereof.

The cavity-aperture 138 is adapted to receive the exposed prong of an H-terminal 28 and to register it electrically with the female lead of a conductor, shown in phantom, the latter engaging the aperture 138 from the opposite extremity of the connector 138. In both FIGS. 7 and 8, the individual aperture 138 is shown as including a shoulder 156 for insuring engagement between the flexible tang of an inserted metallic terminal and its opposite connector female lead.

Figure 9:
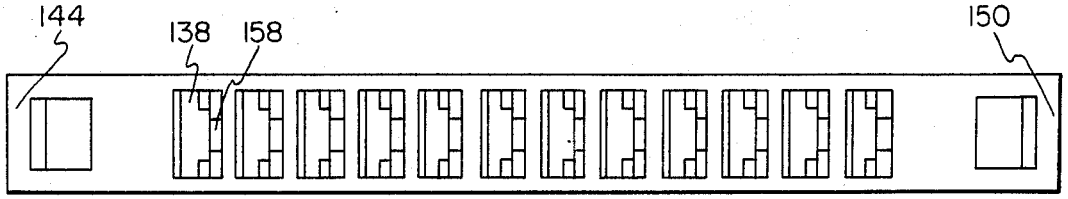
FIG. 9 is a bottom plan of the connector head.

In FIG. 9 there is shown an alignment slot 158 defined at the bottom of each concavity 138. These details are further illustrated in FIGS. 10 and 11.

In FIG. 12 there are illustrated a plurality of key combinations for the key posts extending outwardly of the H-terminal assembly for mating engagement with corresponding keyholes defined in the connector head.

As will be apparent, the present H-terminal strip assembly is used as a junction block. Conventionally, the hundreds of lead wires in a school bus electrical system are plugged into a harness adjacent the relay switch panel. This is a complex system which is difficult to assemble, test and maintain. According to the present invention, the school bus wiring system components are connected to the terminal connector heads which plug directly into the H-terminal strip assembly. The key post combinations will ensure appropriate connection without the necessity for reference or check.

Manifestly, the H-terminal assembly may be variously configured without departing from the spirit and scope of the invention as defined in the sub-joined claims.

I claim:

1. An H-terminal assembly for electrical wiring systems of the type employing pronged H-terminals comprising:

a. a plurality of flat H-terminals having top and bottom prongs;

b. a top section of insulating material defining a planar base with a plurality of aligned holes which register with the H-terminal top prongs, said top section further including:

i. a plurality of resilient bayonet prongs extending upwardly from said planar base so as to engage a terminal connector head, and ii. at least one elongated key post extending upwardly from said planar base for registration with a terminal connector head;

iii. side walls extending above and below said top section planar base, together with a plurality of lugs extending laterally from the bottom of said side walls c. a bottom section of insulating material defining a planar base with a plurality of aligned holes which register with the H-terminal bottom prongs, said bottom section being snap-fitted to said top section, such that the pluralities of holes in said top section and bottom section register with each other as a support for said H-terminals, said bottom section further including:

i. a plurality of bayonet prongs extending downwardly from said bottom section base, so as to engage a terminal connector head; and ii. at least one elongated key post extending downwardly from said planar base, for registration with a connector head;

iii. a plurality of bracket members extending upwardly from said planar base, so as to engage said laterally extending lugs in said top section.

d. at least two electrical terminal connector heads of insulating material each defining a plurality of electrical connector concavities, providing for connector registration with aligned H-terminal prongs, extending from the planar surface of said top and bottom sections and each said connector head having elongated keyholes complementally engaging said key posts whereby upon registry of the keyposts with the keyholes, the connector heads receive the bayonet prongs, such that each connector head is snap-fitted onto the planar base respectively of said top section and said bottom section.

2. An H-terminal assembly for electrical wiring systems of the type employing pronged H-terminals as in claim 1, said top section planar base, including two rows of aligned holes, together with bayonet prongs extending upwardly from said planar base at each end of said rows and said bottom planar base including three rows of aligned holes with bayonet prongs extending downwardly at each end of said rows, such that said assembly accommodates a plurality of five-prong H-terminals.

3. An H-terminal assembly for electrical wiring systems of the type employing pronged H-terminals as in claim 2, further including pairs of keyposts for each row of aligned holes, said pairs of keyposts being differently configured for mating with electrical connector heads having mating keyholes.

4. An H-terminal assembly for electrical wiring systems of the type employing pronged H-terminals as in claim 3, said top section and said bottom section including curvate half-brackets extending from either end, said curvate half-brackets on said top section and said bottom section abutting each other as said sections are joined together to form a fastening bracket.

5. The combination of an H-terminal assembly for electrical wiring systems of the type employing pronged H-terminals and connector heads as in claim 1, said electrical connector concavities being configured complementally to support therein metallic terminals for connection to said H-terminals.

* * * * *